US008480047B2

(12) United States Patent
Sloan

(10) Patent No.: US 8,480,047 B2
(45) Date of Patent: Jul. 9, 2013

(54) FLEXIBLE ADJUSTABLE STORAGE SYSTEM FOR SEA-LAND SHIPPING CONTAINERS

(76) Inventor: Michael J. Sloan, Coeur d'Alene, ID (US)

( * ) Notice: Subject to any disclaimer, the term of this patent is extended or adjusted under 35 U.S.C. 154(b) by 738 days.

(21) Appl. No.: 12/653,074

(22) Filed: Dec. 8, 2009

(65) Prior Publication Data

US 2011/0062301 A1 Mar. 17, 2011

Related U.S. Application Data

(63) Continuation-in-part of application No. 11/026,001, filed on Dec. 31, 2004, now abandoned, and a continuation-in-part of application No. 11/901,976, filed on Sep. 21, 2007, now Pat. No. 7,651,065.

(51) Int. Cl.
*B42F 13/00* (2006.01)

(52) U.S. Cl.
USPC ..... 248/243; 248/250; 211/90.01

(58) Field of Classification Search
USPC ..... 248/235, 250, 240.2, 249, 240.3, 248/240.4, 241, 243, 244, 245; 211/90.01, 211/90.03, 90.04
See application file for complete search history.

(56) References Cited

U.S. PATENT DOCUMENTS

| | | | | |
|---|---|---|---|---|
| 2,804,742 | A * | 9/1957 | Ray | 54/46.1 |
| 3,799,072 | A * | 3/1974 | Slaboden | 108/107 |
| 4,388,982 | A * | 6/1983 | Yonahara | 182/82 |
| 4,685,575 | A * | 8/1987 | Kulbersh | 211/90.02 |
| 6,116,164 | A * | 9/2000 | Justen, Jr. | 108/42 |
| 6,224,029 | B1 * | 5/2001 | Marble et al. | 248/214 |
| 6,814,418 | B2 * | 11/2004 | D'Orso | 312/351 |

* cited by examiner

*Primary Examiner* — Terrell McKinnon
*Assistant Examiner* — Steven Marsh

(57) ABSTRACT

A flexible and adjustable storage system for inside a Sea-Land shipping container provides at least two hangers, each hanger having a releasable anchor for attachment to a lashing ring, a flexible member of a vertical support depending from the releasable anchor, at least one rigid horizontal support member having a first end portion and a spaced apart second end portion, each end portion carrying an adjustable fastener for adjustable attachments to the flexible member for vertical support.

3 Claims, 9 Drawing Sheets

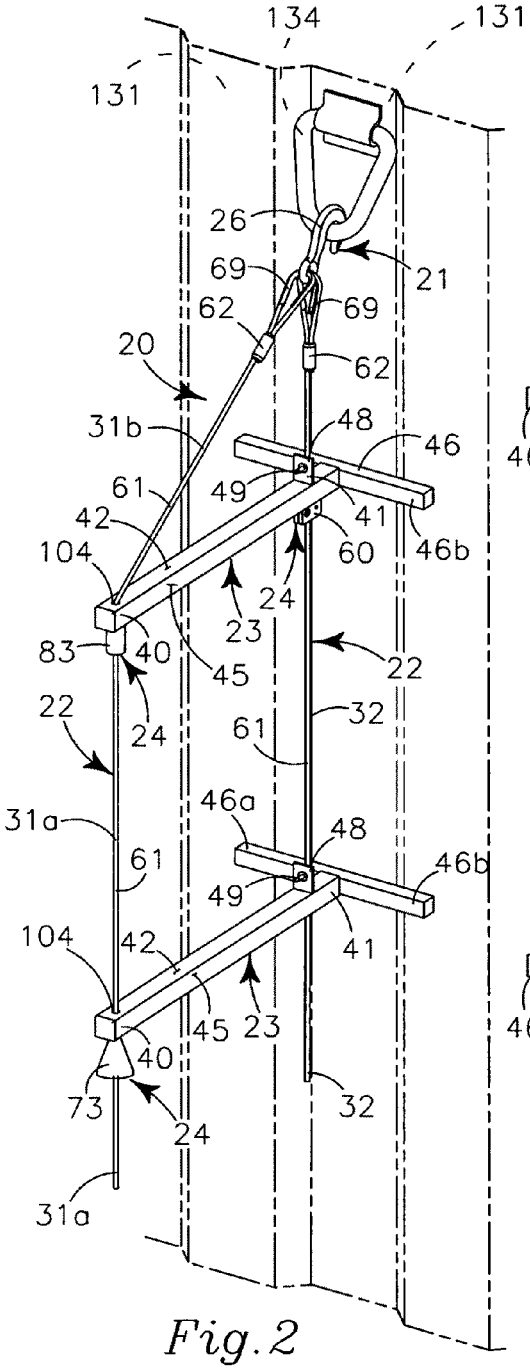
Fig. 2
Fig. 7
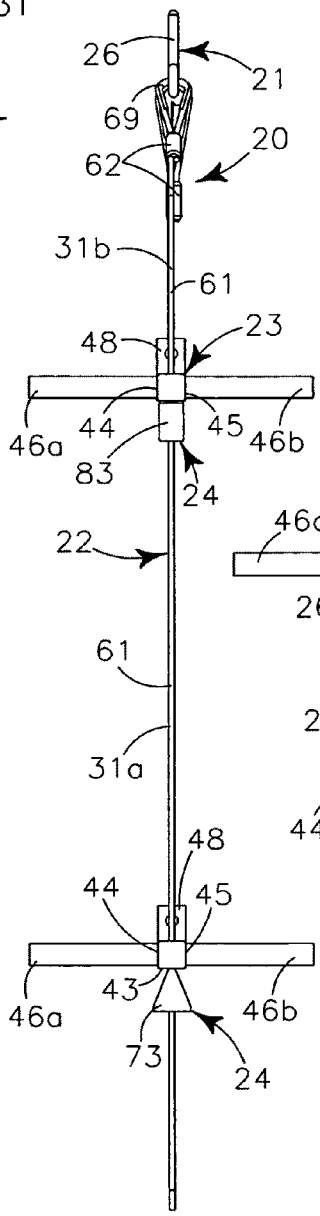
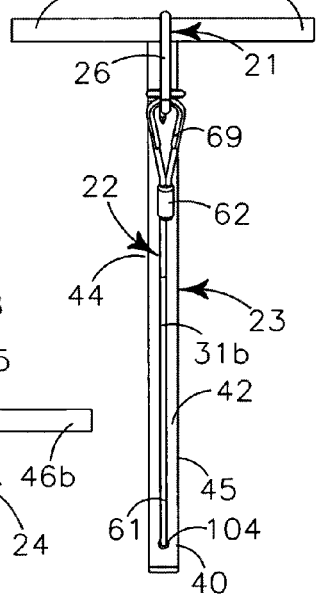
Fig. 8

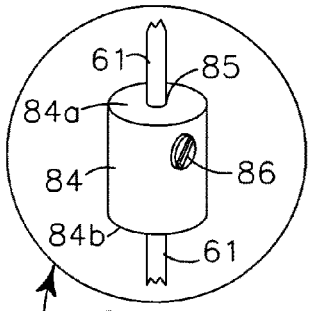
Fig. 4
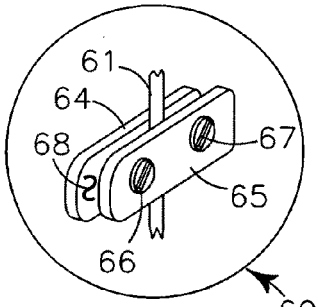
Fig. 5
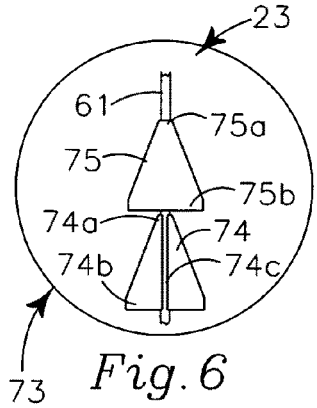
Fig. 6
Fig. 3
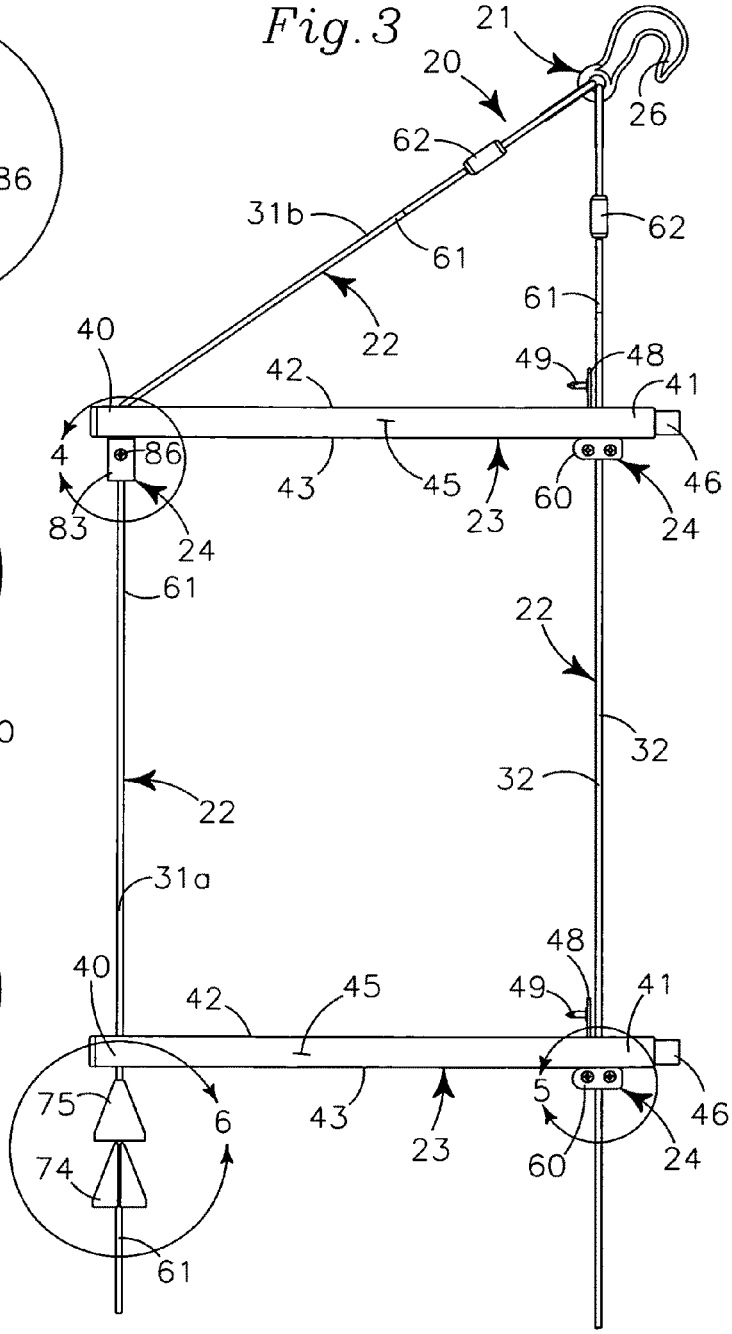

Fig. 20
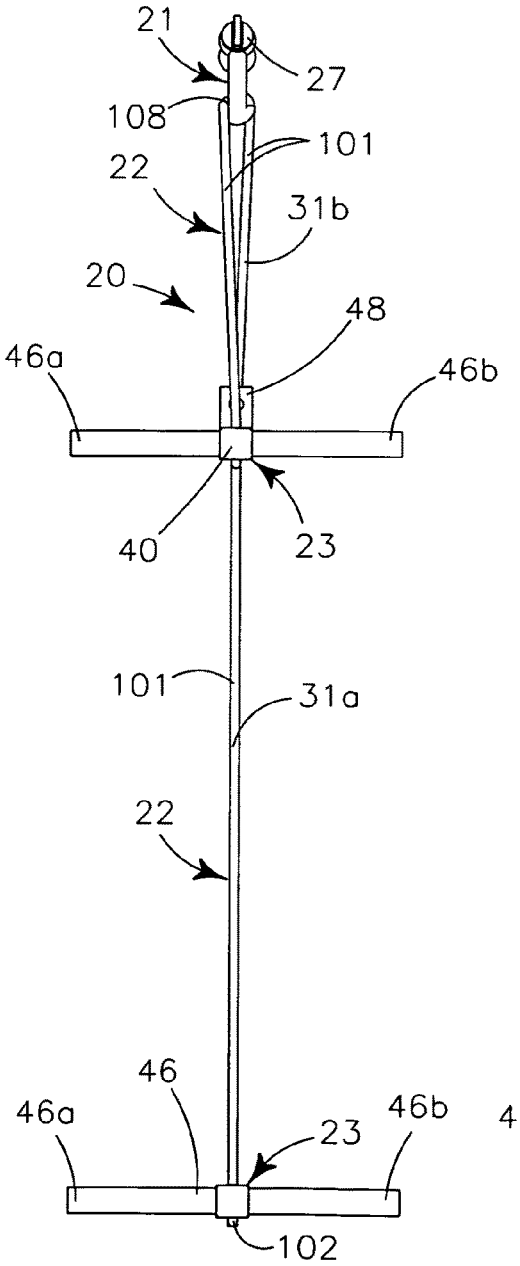
Fig. 21
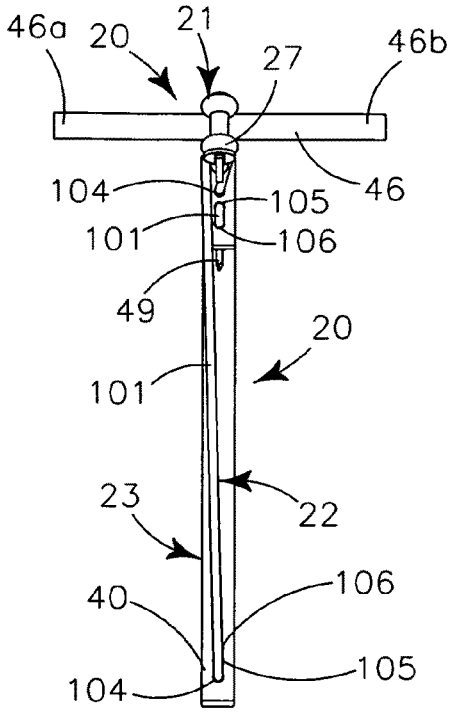
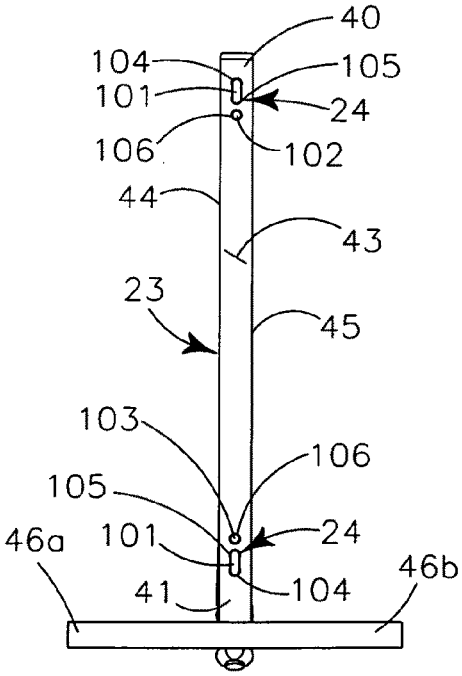
Fig. 22

FLEXIBLE ADJUSTABLE STORAGE SYSTEM FOR SEA-LAND SHIPPING CONTAINERS

RELATED APPLICATIONS

This application is a Continuation in Part of application Ser. No. 11/026,001 filed on Dec. 31, 2004 now abandoned, titled "Article of Manufacture Comprising a Support System for the Support of a Shelf or Shelves or Other Rigid or Non-Rigid Materials", and a Continuation in Part of application Ser. No. 11/901,976 filed on Sep. 21, 2007 now U.S. Pat. No. 7,651,065, titled "Storage System for Sea-Land Shipping Containers", both of which are hereby incorporated herein by reference in their entirety.

BACKGROUND OF INVENTION

1. Field of Invention

This invention relates to supports and racks, and more particularly to flexible adjustable shelving systems that depend from lashing rings, inside a Sea-Land shipping container, immediately adjacent a vertical wall.

2. Background and Description of Prior Art

Many individuals are employed in the construction field, such as electricians, plumbers, framers and the like. Frequently, these individuals require weatherproof and secure temporary on-site storage for their tools, equipment and supplies. One method of meeting the demand for such temporary on-site storage is through the use of Sea-Land shipping containers which are ideal for providing weatherproof, secure, temporary on-site storage because they are sturdy, they are weather resistant and they are portable. Unfortunately, Sea-Land shipping containers are typically void of any structure or method for organizing materials to be stored therein requiring that the user install some sort of shelving or storage system.

Various shelving and storage systems are known, but such systems are commonly permanently anchored to a vertical wall, or are anchored to the floor obstructing valuable floor space that is most conducive to storage of heavy items such as bags of concrete, welding machines, power equipment, large heavy items and the like.

Because most Sea-Land shipping containers that are used as temporary storage are rented, it is not practical to drill holes in the container to anchor shelving and storage systems or to otherwise damage the container because the user may be charged for the damage and because the damage may compromise the weather-proofness of the container. Further, such permanently attached shelving and storage systems do not lend themselves to portability, may be costly in both materials and labor, and are often discarded at the close of construction when the need for the temporary on-site storage space no longer exists.

What is needed is a flexible adjustable storage system for support of shelves and for support of rigid and non-rigid construction materials, supplies and equipment that does not interfere with the floor space therebelow, and does not require anchoring methods that damage or otherwise compromise the weatherproofness of the shipping container.

The support system should be easy to install, portable and sufficiently durable to withstand the rigors of use in a construction-site setting. Further, such support system must be easily storable when not in use, and easily reinstalled when needed. Additionally the support system should be adjustable to allow customization depending upon the particular need.

My flexible adjustable storage system for Sea-Land shipping containers provides such a device and resolves various of the aforementioned drawbacks.

My flexible adjustable storage system for Sea-Land shipping containers provides a user friendly, flexible and infinitely adjustable portable and durable storage system that depends from lashing rings structurally carried in spaced apart array inside the shipping container proximate interconnection of a vertical wall and a ceiling. My storage system does not interfere with the floor space within the shipping container, does not require drilling holes in the shipping container, is easy to install and uses flexible supports upon which rigid shelf supports may be infinitely adjustably positioned, promotes space saving for storage and are easily removed, stored and reinstalled.

My invention does not reside in any one of the identified features individually but rather in the synergistic combination of all of its structures, which give rise to the functions necessarily flowing therefrom as hereinafter specified and claimed.

SUMMARY

A flexible adjustable storage system for inside a Sea-Land shipping container provides at least two hangers, each hanger having a releasable anchor for releasable attachment to lashing ring, a flexible member for depending support depending from the releasable anchor, at least one rigid horizontal support member having a first end portion and a spaced apart second end portion, each end portion carrying an adjustable fastening means for adjustable attachment to the flexible member for depending support.

In providing such an apparatus it is:

a principal object to provide a storage system for inside a Sea-Land shipping container.

a further object to provide such a storage system that utilizes flexible members for vertical support.

a further object to provide such a storage system having height adjustable rigid horizontal support members.

a further object to provide such a storage system may be rolled up for compact storage when not in use.

a further object to provide such a storage system that does not require modification of the Sea-Land shipping container.

a further object to provide such a storage system that depends along an interior vertical wall.

a further object to provide such a storage system that does not occupy floor space inside a Sea-Land shipping container.

a further object to provide such a storage system that enhances accessibility to stored materials inside a Sea-Land shipping container.

a further object to provide such a storage system that is adjustable, user friendly and easy to install.

a further object to provide such a storage system that easy to disassemble and store when not in use.

a still further object to provide such a storage system that is of new and novel design, of rugged and durable nature, of simple and economic manufacture and one that is otherwise well suited to the uses and purposes for which it is intended.

Other and further objects of my invention will appear from the following specification and accompanying drawings which form a part hereof. In carrying out the objects of my invention it is to be understood that its structures and features are susceptible to change in design and arrangement with only one preferred and practical embodiment of the best known mode being illustrated in the accompanying drawings and specified as is required.

BRIEF DESCRIPTIONS OF DRAWINGS

In the accompanying drawings which form a part hereof and wherein like numbers refer to similar parts throughout:

FIG. 2 is an isometric front, top and right side view of a cable-type hanger with a hook-type releasable anchor depending from a lashing ring and adjustably supporting two vertically spaced apart rigid horizontal support members.

FIG. 3 is an orthographic right side view of the hanger of FIG. 2.

FIG. 4 is an enlarged isometric top and side view of a one piece compression fixture adjustable fastening means.

FIG. 5 is an enlarged isometric top and side view of a two piece plate-type compression fixture adjustable fastening means.

FIG. 6 is an enlarged orthographic side view of a second two piece conic-type compression fixture adjustable fastening means.

FIG. 7 is an orthographic front view of the hanger FIG. 3.

FIG. 8 is an orthographic top view of the hanger of FIG. 3.

FIG. 20 is an orthographic front view of the hanger of FIG. 18.

FIG. 21 is an orthographic top view of the hanger of FIG. 18.

FIG. 22 is an orthographic bottom view of the hanger of FIG. 18.

DESCRIPTION OF PREFERRED EMBODIMENT

Figure 1:
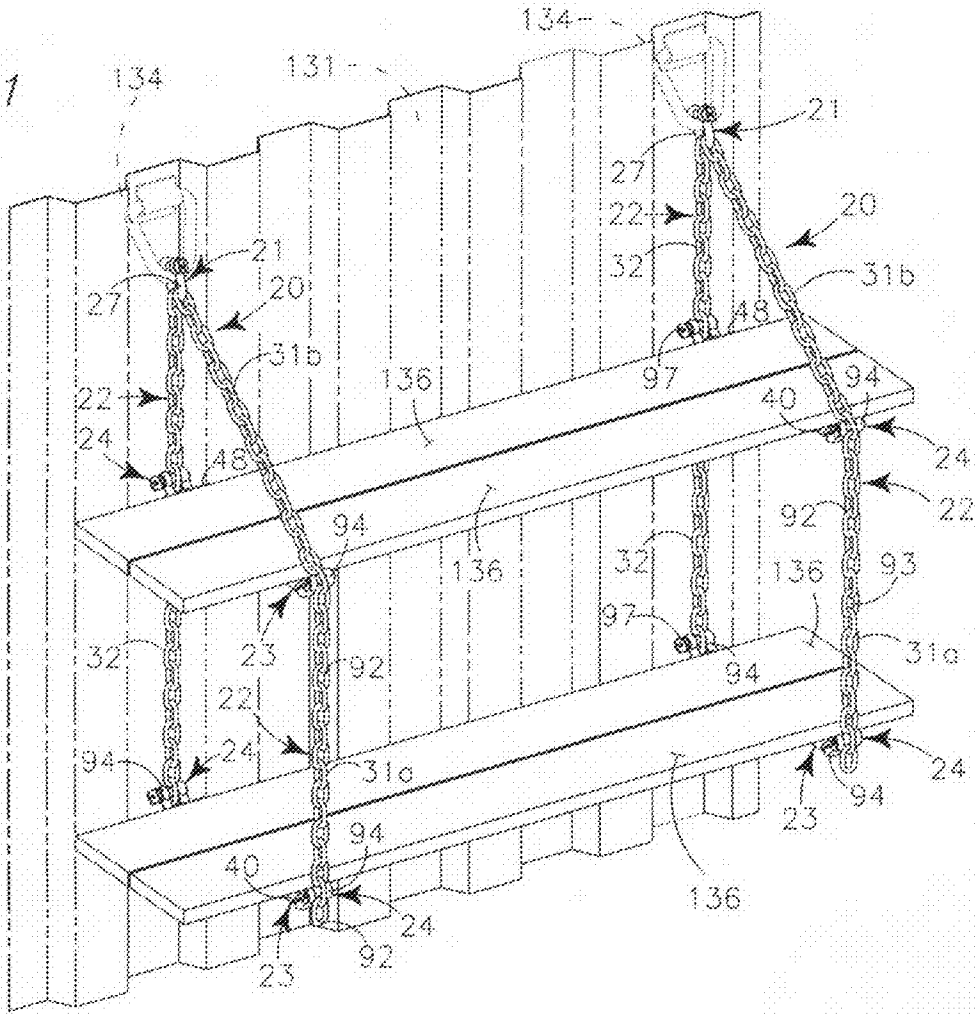
FIG. 1 is an isometric front, top and left side environmental view of two spaced apart hangers depending from lashing rings inside a Sea-Land container with shelf planks installed on the rigid horizontal support members.
Figure 9:
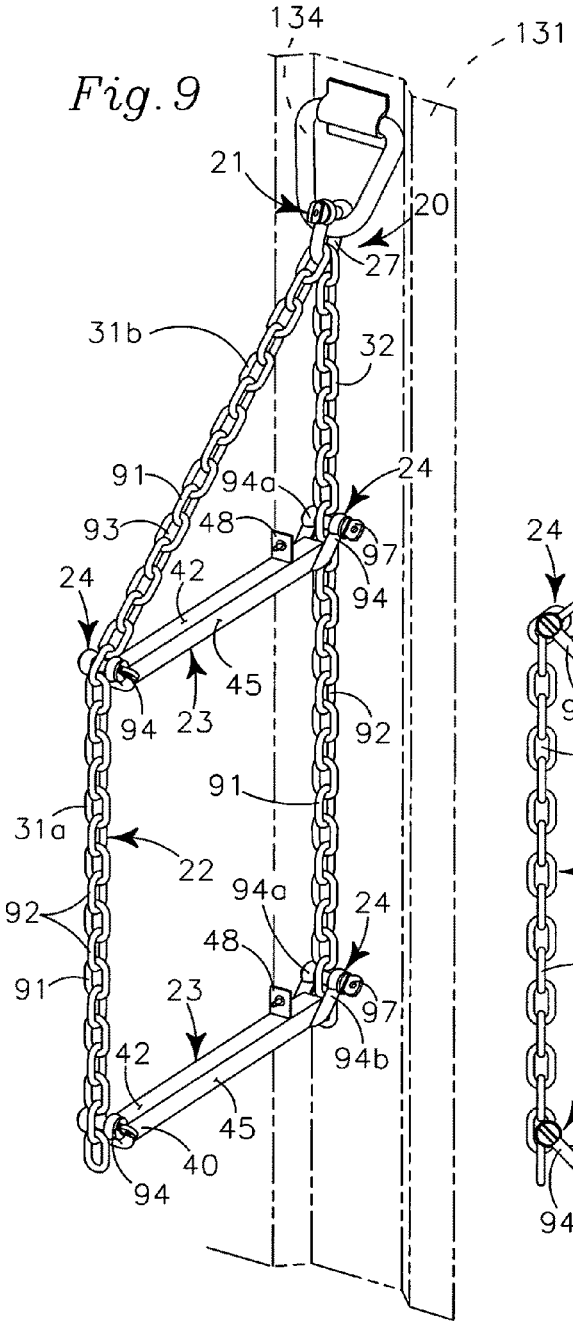
FIG. 9 is an isometric front, top and right side view of a chain-type hanger with a clevis-type releasable anchor depending from a lashing ring and adjustably supporting two vertically spaced apart rigid horizontal support members.
Figure 10:
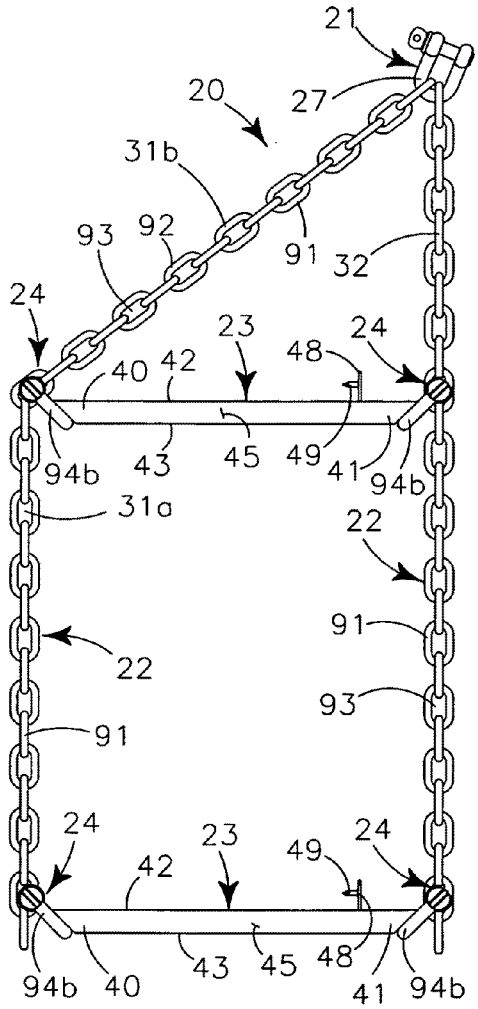
FIG. 10 is an orthographic right side view of hanger of FIG. 9.
Figure 11:
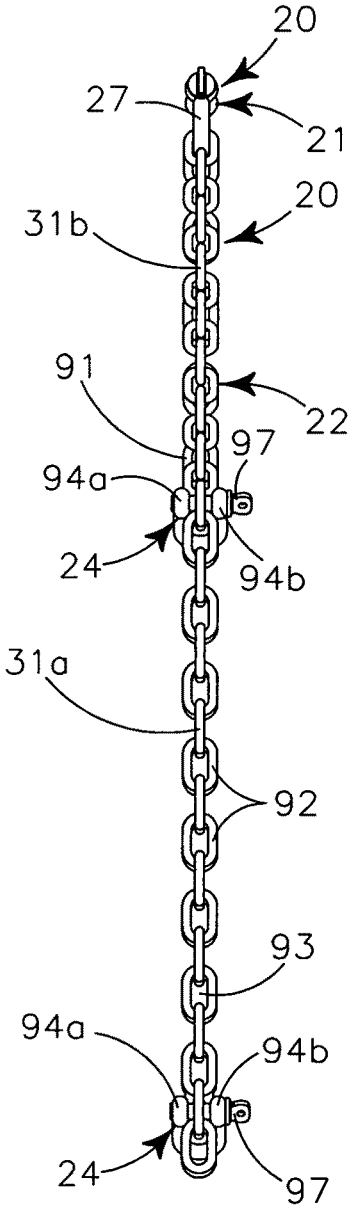
FIG. 11 is an orthographic front view of the hanger of FIG. 9.
Figure 12:
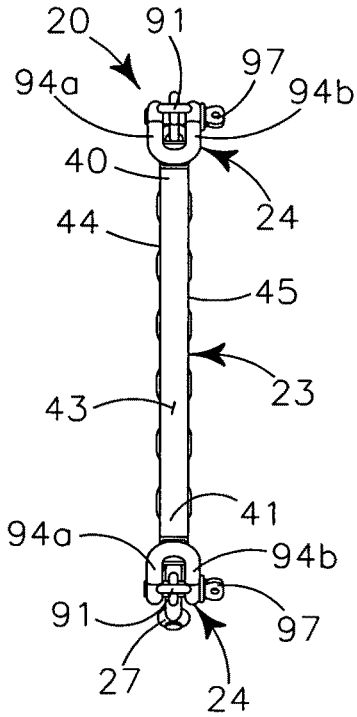
FIG. 12 is an orthographic bottom view of the hanger of FIG. 9.
Figure 13:
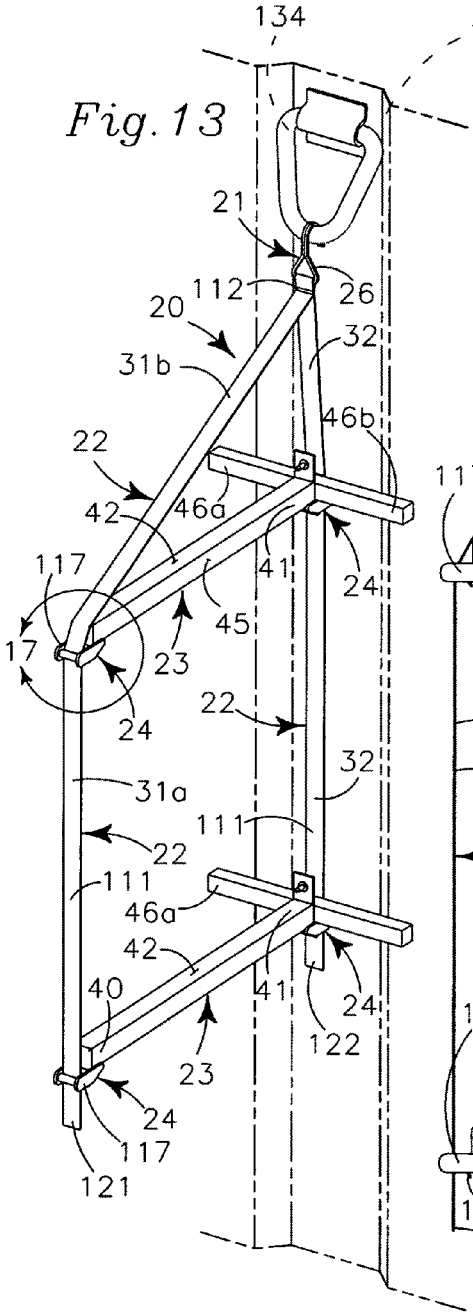
FIG. 13 is an isometric front, top and right side view of strap-type hanger with a hook-type releasable anchor depending from a lashing ring and adjustably supporting two vertically spaced apart rigid horizontal support members.
Figure 14:
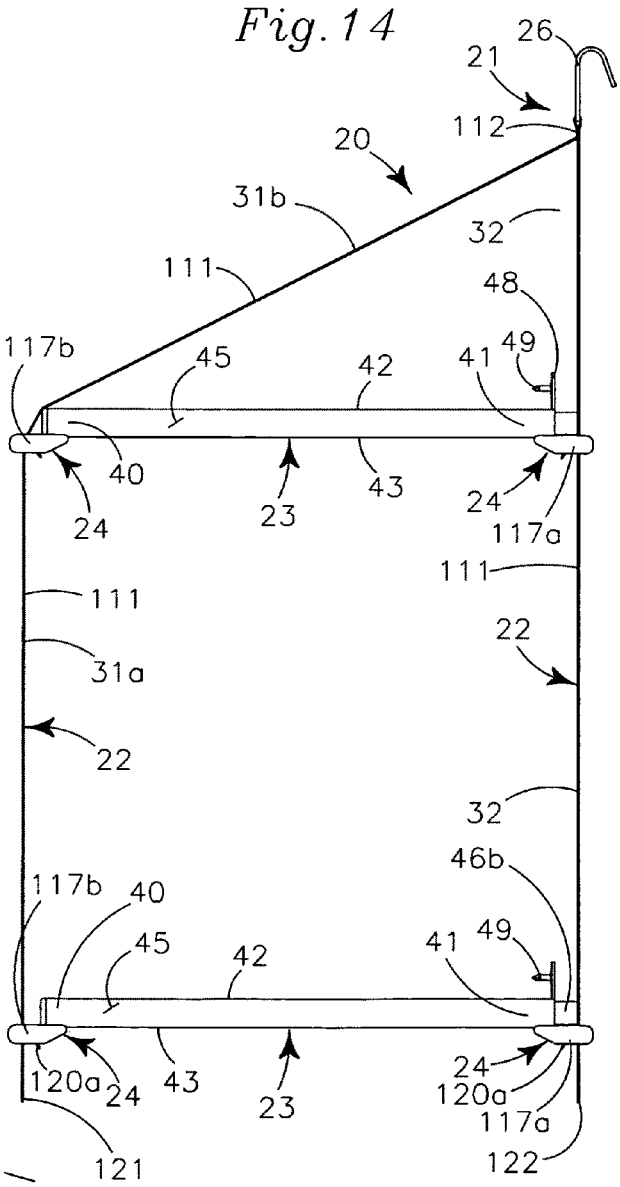
FIG. 14 is an orthographic right side view of the hanger of FIG. 13.
Figure 15:
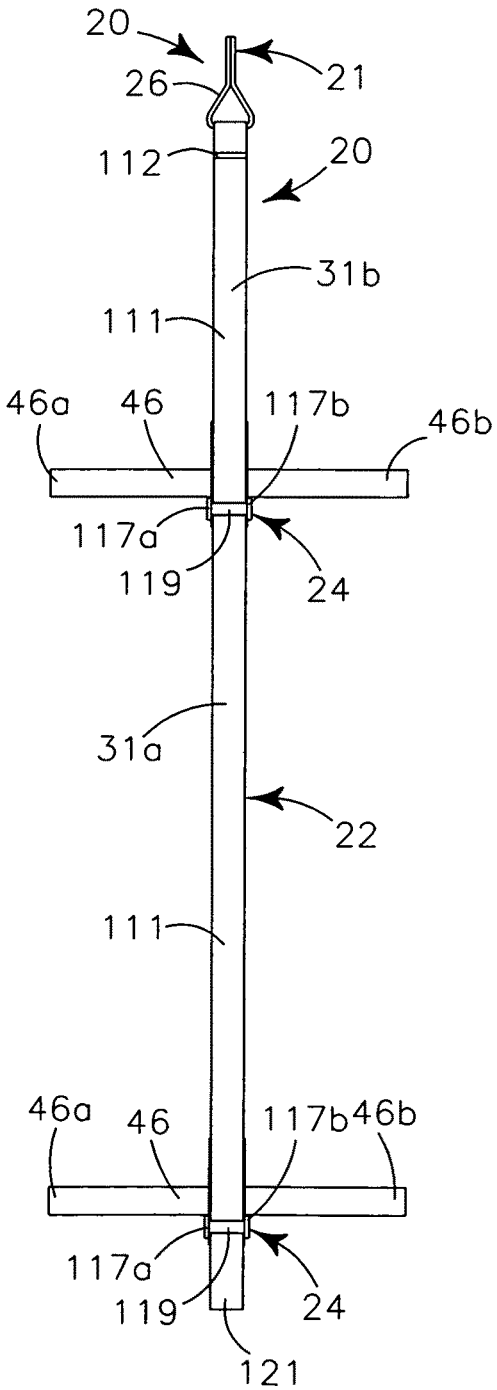
FIG. 15 is an orthographic front view of the hanger of FIG. 13.
Figure 17:
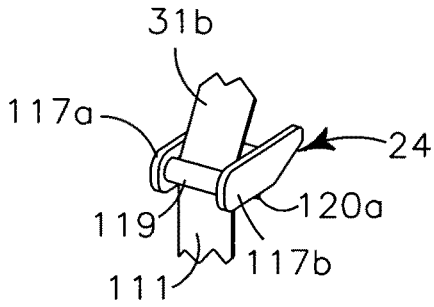
FIG. 17 is an enlarged isometric front, top and side view of a cam buckle type adjustable fastening means.

As used herein, the term "top", its derivatives, and grammatical equivalents refers to the portion of my flexible adjustable storage system for Sea-Land shipping containers that is proximate shipping container top. The term "bottom", its derivatives, and grammatical equivalents refers to the portion of my flexible adjustable storage system for Sea-Land shipping containers that is proximate shipping container bottom. The term "back", its derivatives, and grammatical equivalents refers to the portion of my flexible adjustable storage system for Sea-Land shipping containers that is proximate shipping container vertical wall. The term "front", its derivatives, and grammatical equivalents refers to the portion of my flexible adjustable storage system for Sea-Land shipping containers that is distal from the shipping container vertical wall.

My flexible adjustable storage system for Sea-Land shipping containers provides at least two hangers 20, each hanger 20 comprising a releasable anchor 21, an elongate flexible member for depending support 22, and at least one rigid horizontal support member 23 carrying an adjustable fastening means 24 at a first end portion 40 and at a spaced apart second end portion 41.

The releasable anchor 21, may take various forms including, but not limited to, a hook 26 (FIGS. 2-8, 13-17), a clevis 27 (FIGS. 1, 9-12, 18-22) on an "S" hook (not shown), a carabiner (not shown), a releasable connecting link also known as a "quick link" (not shown) and the like so long as the releasable anchor 21 is releasably interconnectable with a lashing ring 134 carried proximate interconnection of Sea-Land shipping container vertical wall 131 and shipping container interior top (not shown).

Flexible member for depending support 22 is generally elongate having a first leg 31 and a second leg 32. The flexible member for depending support 22 interconnects with the releasable anchor 21 and extends both vertically downwardly and angularly downward therefrom. The flexible member for depending support 22 may likewise take various forms including cable 61, chain, 91, strap 111, rope 101 and the like, so long as the form retains the characteristics of being flexible, strong, durable and is adjustably releasably interconnectable with adjustable fastening means 24.

When the flexible member for depending support 22 is formed of cable 61 (FIGS. 2-8) a loop support 69 and a permanent compression fixture 62 may be used to interconnect the cable 61 with hook-type 26 releasable anchor 21.

Flexible member for depending support 22 may also be a link chain 91, (FIGS. 1, 9-12) having a plurality of interconnected chain links 92. Each chain-link 92 defining a space 93 in medial portion of each chain link 92.

Flexible member for depending support 22 may also be strap 111 (FIGS. 13-17) formed of a material such as polyester, polyethylene, nylon and the like. When the flexible member for vertical support 22 is a strap 111, it is preferred the interconnection with the releasable anchor 21 have transverse stitching 112 to prevent the strap-type flexible member for depending support 22 from sliding relative to the releasable anchor 21.

It is also contemplated the flexible member for depending support 22 may also be a rope 101, (FIGS. 18-22).

The flexible member for depending support 22 interconnects with the releasable anchor 21 so that the second leg 32 extends generally vertically downwardly from the releasable anchor 21 proximate the shipping container vertical wall 131. The first leg 31 has a vertical portion 31*a* horizontally spaced apart from the second leg 32 and an upper angular portion 31*b*. The angular portion 31*b* extends generally angularly forwardly and downwardly from releasable anchor 21 to communicate with adjustable fasting means 24 at first end portion 40 of the rigid horizontal support member 23. The vertical portion 31*a* of the first leg 31 depends from the adjustable fastening means 24 at the first end portion 40 of the rigid horizontal support member 23 spaced apart from the shipping container vertical wall 131 and spaced apart from the second leg 32. The angular portion 31*b* of the first leg 31 may vary in length depending upon the dimensions of the upper most rigid horizontal support member 23.

The rigid horizontal support member 23 is preferably formed of an elongate section of the box beam but may be formed of other materials such as an "I" beam, a "U" channel, a pipe or other metallic or non-metallic materials such as wood or plastic so long as the member is rigid and strong and the releasable fastening means 24 may be carried thereby. Each rigid horizontal support member 23 has a first end portion 40, a spaced apart opposing second end portion 41, a top portion 42, a bottom portion 43, a first side portion 44 and a second side portion 45.

Squaring foot 46, having a first end portion 46*a*, and the second end portion 46*b* may be permanently or releasably interconnected with the second end portion 41 of the rigid horizontal support member 23 to extend horizontally perpendicularly from the rigid horizontal support member 23 immediately adjacent the shipping container vertical wall 131. Squaring foot 46 may be used to prevent hanger 20 and the rigid horizontal support member 23 from twisting relative to the shipping container vertical wall 131 and to ensure that the rigid horizontal support member 23 extends perpendicularly outwardly from the shipping container vertical wall 131.

Shelf barb bracket 48 is carried on the top portion 42 of the rigid horizontal support member 23 spacedly adjacent the second end portion 41. Pointed shelf barb 49 extends perpendicularly forwardly from the shelf barb bracket 48 parallel to the rigid horizontal support member 23 to engage with a vertical edge portion of a shelf plank 136 to positionally secure the shelf plank 136 and prevent the shelf plank 136 from sliding relative to the rigid horizontal support member 23.

Adjustable fastening means 24 is carried at the first end portion 40 and the second end portion 41 of each rigid horizontal support member 23 to adjustably interconnect with first leg 31 and second leg 32 of flexible member for depending support 22 to support to rigid horizontal support member 23 thereon. The adjustable fastening means 24 may take various forms including, but not limited to, one part compression fixtures 83, two part compression fixtures 60, 73, clevises 94, cam buckles 117, through holes 104, 105, 106 defined in the first and second end portions 40, 41 respectively of the rigid horizontal support member 23, and the like.

In a first embodiment the flexible member for depending support 22 is a cable 61 passing through holes 104 defined in the first end portion 40 and the second end portion 41 of the rigid horizontal support member 23 and the adjustable fastening means 24 is a one-piece adjustable compression fixture 83 (FIG. 4) formed of a cylindrical barrel 84 having a top end portion 84*a*, a bottom end portion 84*b* and defining an axially aligned medial channel 85 through which the cable 61 extends. A set screw 86 is carried in a radially aligned threaded hole (not shown) defined in the barrel 84 so that inner end portion (not shown) of the set screw 86 frictionally engages with the cable 61 to positionally secure the barrel 84 on the cable 61. The rigid horizontal support member 23 may rest directly upon the top end portion 84*a* the barrel 84 which supports the rigid horizontal support member 23 on the cable-type flexible member for depending support 22.

In a second embodiment (FIG. 5) the adjustable fastening means 24 is a two piece adjustable compression fixture 60 formed of a first plate 64 and a spacedly adjacent second plate 65, each plate 64, 65 having a similar peripheral configuration and each defining a pair of spaced apart fastener holes (not shown) carrying a first threaded fastener 66 and a second threaded fastener 67. Cable 61 extends between the first plate 64 and the second plate 65 and is positioned between the first threaded fastener 66 and the second threaded fastener 67. By tightening the first and second threaded fasteners 66, 67 the cable 61 is squeezed between the first plate 64 and the second plate 65 positionally securing the plates 64, 65 to the cable 61. The rigid horizontal support member 23 may thereafter frictionally rest upon upper edge portion of the plates 64, 65 to positionally support the rigid horizontal support member 23 on the cable-type flexible member for depending support 22.

In a third embodiment (FIG. 6) the adjustable fastening means 24 is a two piece adjustable compression fixture 73 comprising a slotted conic 74 having a top end portion 74*a*, a vertically spaced apart diametrically enlarged bottom end portion 74*b* and defining an axial slot 74*c* extending therebetween for carriage of the cable 61 therein. A hollow conic barrel 75 having a top end portion 75*a* and a vertically spaced apart diametrically enlarged bottom end portion 75*b* defining an interior conic chamber (not shown) and defining an axially centered hole (not shown) in the top end portion 75*a* is carried on the cable 61 immediately above the slotted conic 74 with the cable 61 extending through the axially centered hole (not shown). The hollow conic barrel 75 is axially engaged with the slotted conic 74 by sliding the hollow conic barrel 75 downwardly onto and over the slotted conic 74. Axial engagement of the hollow conic barrel 75 with the slotted conic 74 causes the slotted conic 74 to be compressed radially inwardly which enhances frictional engagement with the cable 61 carried within the axial slot 74*c* and positionally secures the two piece adjustable compression fixture 73 on the cable 61. The rigid horizontal support member 23 may thereafter frictionally rest directly upon the top end portion 75*a* of the two-piece adjustable compression fixture 73 to positionally support to the rigid horizontal support member 23 on the cable-type flexible member for depending support 22.

In a fourth embodiment, (FIGS. 1, 9-12), the adjustable fastening means 24 is a clevis 94 structurally carried at the first end portion 40 and at the second end portion 41 of the rigid horizontal support member 23. Each clevis 94 has a first end portion 94*a* and a spaced apart second end portion 94*b*. The first end portion 94*a* and the second end portion 94*b* each define through hole (not shown) one of which is threaded for engagement with one end portion of a clevis pin 97 that extends therethrough and engages therewith. The clevis pin 97 extends through space 93 defined by a chain link 92. Engagement of the clevis 94 at the first end portion 40 of the rigid horizontal support member 23 with the first leg 31 of the chain-type flexible member for depending support 22 and engagement of the clevis 94 at the second end portion 41 of the rigid horizontal support member 23 with the second leg 32 of the chain-type flexible member for depending support 22 positionally secures the rigid horizontal support member 23 relative to the chain-type flexible member for depending support 22. As shown in FIGS. 1 and 9-12 the releasable anchor 21 supporting the chain-type flexible member for depending support 22 may also be a clevis 27 interconnected with the lashing ring 134.

Figure 16:
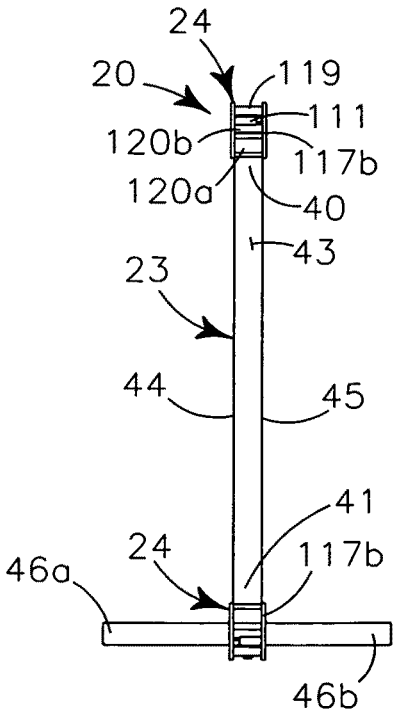
FIG. 16 is an orthographic bottom view of a hanger of FIG. 13.
Figure 18:
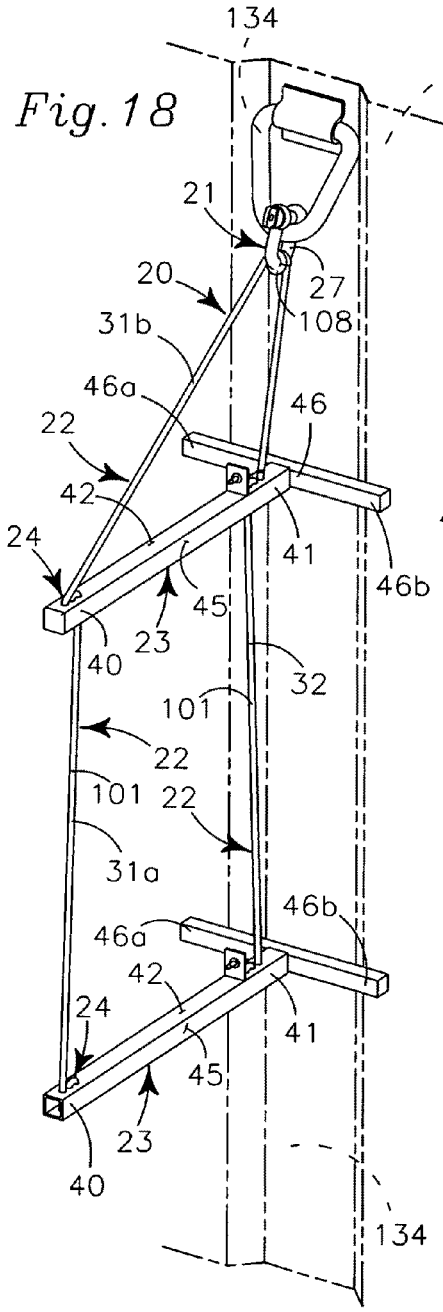
FIG. 18 is an isometric front, top, and right side view of a rope-type hanger with a clevis-type releasable anchor depending from a lashing ring and adjustably supporting two vertically spaced apart rigid horizontal support members.
Figure 19:
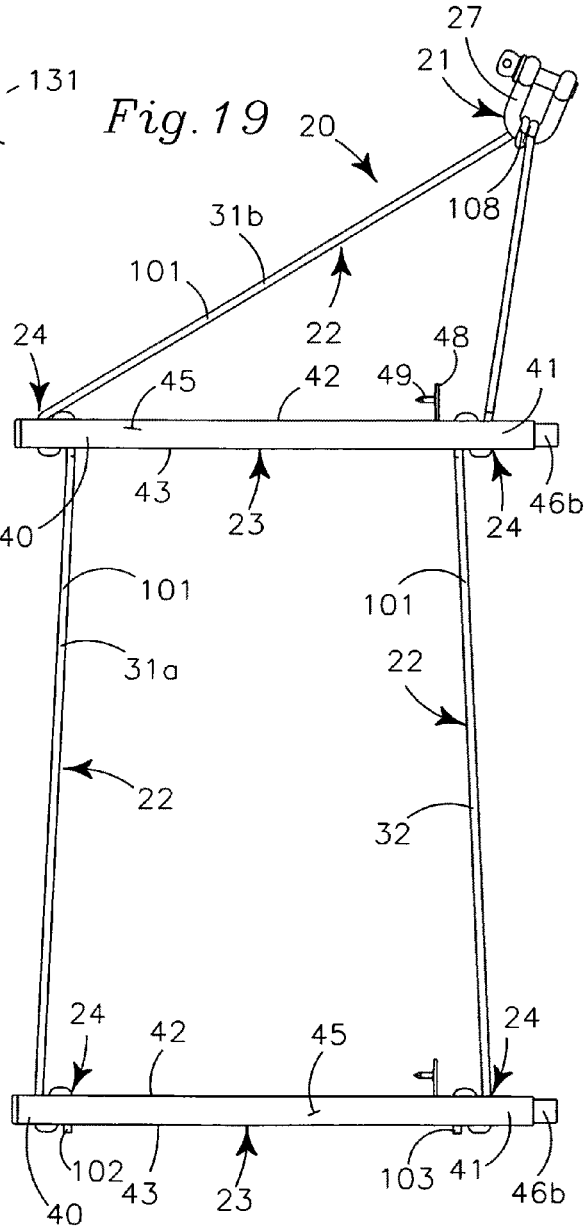
FIG. 19 is an orthographic right side view of the hanger of FIG. 18.

In a fifth embodiment (FIGS. 13-17) the flexible member for depending support 22 is an elongate strap 111 preferably formed of material such as, but not limited to, polyester, polyethylene, nylon and the like, and the adjustable fastening means 24 is cam buckle 117 carried at the first end portion 40 and the second end portion 41 of the rigid horizontal support member 23. Cam buckle 117 has a first side portion 117*a* and a spaced apart parallel second side portion 117*b*. A generally cylindrical cam 119 (FIG. 17) is carried between the first and second side portions 117*a*, 117*b* extending perpendicularly therebetween and having an exterior surface (not shown) that enhances frictional engagement with the strap 111. Spring biased lever 120 is also carried between the first and second portions 117*a*, 117*b* spacedly adjacent cam 119. (FIG. 16). The spring biased lever 120 has a cam-end portion 120*b* with an exterior surface (not shown) that enhances frictional engagement with the strap 111. Opposite and spaced apart from the cam end portion 120*b* is handle 120*a* for manual release of the cam buckle 117 when the handle 120*a* is depressed by a user. The spring biased lever 120 is biased to frictionally squeeze strap 111 between the cam 119 and the cam end portion 120*b* of the spring biased lever 120 to positionally secure the rigid horizontal support member 23 to the strap-type flexible member for depending support 22.

In a sixth embodiment (FIGS. 18-22) the flexible member for depending support 22 is a rope 101 and the adjustable fastening means 24 comprises plural spaced apart through holes 104, 105, 106 defined in the first end portion 40 and in a second end portion 41 of the rigid horizontal support member 23 extending from the top portion 42 through the bottom portion 43. The rope 101 is threaded through first through hole 104 spacedly adjacent the proximate end portion 40, 41 of the rigid horizontal support member 23. The rope 101 is then threaded through the second through hole 103 from the bottom 43 to the top 42. Thereafter the rope 101 is threaded downwardly through the third through hole 106 that is distal from the proximate end portion 40, 41 from the top 42 through the bottom 43. Threading of the rope 101 through the holes 104, 105, 106 provides the adjustable fastening means 24 for adjustably interconnecting the rigid horizontal support member 23 to the rope-type flexible member for depending support 22.

Having described the structure of my flexible adjustable storage system for Sea-Land shipping containers, its operation may be understood.

A hanger 20 is positioned adjacent the vertical wall 131 inside a Sea-Land shipping container. The lashing ring 134 is maneuvered so that the releasable anchor 21 may be engaged therewith. The releasable anchor 21 is interconnected with the lashing ring 134 so that the first and second legs 31, 32 respectively, of the flexible member for depending support 22 depend vertically therefrom adjacent the Sea-Land shipping container vertical wall 131.

Terminal end portion of first leg 31 of cable 61 is threaded through hole 104 defined in the first end portion 40 of rigid horizontal support member 23 from the top portion 42 through the bottom portion 43. Similarly, terminal end portion of the second leg 32 of cable 61 is threaded through hole 104 defined in the second end portion 41 of the rigid horizontal support member 23. The rigid horizontal support member 23 is moved upwardly, along the cable 61 with the first and second legs 31, 32 of the cable-type flexible member for depending support 22 passing through holes 104 until the rigid horizontal support member 23 is at the desired height. The adjustable fastening means 24 are thereafter interconnected with and positionally secured on the first leg 31 and on the second leg 32 of the cable 61 immediately adjacent below the bottom 43 of the rigid horizontal support member 23. Thereafter the rigid horizontal support member 23 is allowed to rest directly upon the upper edge portion of the adjustable fastening means 24.

The position of the adjustable fasteners 24 on the first and second legs 31, 32 of the flexible member for depending support 22 may be adjusted as desired so that the rigid horizontal support member 23 is horizontal and extends perpendicularly from the shipping container vertical wall 131. The installation process is repeated if additional vertically spaced apart rigid horizontal support members 23 are to be installed on the hanger 20 spacedly below the upper rigid horizontal support member 23.

If the adjustable fastening means 24 is a plate-type two piece adjustable compression fixture 60 (FIG. 5) the first plate 64 and a second plate 65 are positioned on diametrically opposite sides of the cable 61. First adjustable fastener 66 is extended through one of the holes (not shown) defined in the first plate 64 and threadably engaged with threaded orifice (not shown) defined in the second plate 65. Second adjustable fastener 67 is inserted through hole (not shown) defined in the second plate 65 and threadably engaged in threaded hole (not shown) defined in the first plate 64. The first adjustable fastener 66 and the second adjustable fastener 67 should be positioned on diametrically opposite sides of the cable 61. Thereafter the first and second adjustable fasteners and 66, 67 are tightened so that the cable 61 is frictionally squeezed between the first plate 64 and second plate 65 so that the adjustable fastener 24 is positionally secured on the cable-type flexible member for depending support 22.

If the adjustable fastening means 24 is a one piece adjustable compression fixture 83 (FIG. 4) the installation of the rigid horizontal support member 23 is similar except that terminal end portions of the first leg 31 and the second leg 32 are inserted to pass through the axial aligned medial channel 85 defined in the barrel 84 extending from the top end portion 84*a* through bottom end portion 84*b*. When the barrel 84 is positioned at a desired height, the set screw 86 is tightened so as to frictionally engage with the cable 61 and positionally secure the one piece adjustable compression fixture 83 at the desired height.

If the adjustable fastening means 24 is a conic-type two piece adjustable compression fixture 73 (FIG. 6) the terminal ends of cable 61, are threaded through the hole (not shown) defined in the top end portion 75*a* of the hollow conic barrel 75. Thereafter, the slotted conic 74 is placed on the cable 61 so that the cable 61 is carried in the slot 74*c* defined in the slotted conic 74. The hollow conic barrel 75 is thereafter moved downwardly along the cable 61 so that the slotted conic 74 is partially within the chamber (not shown) defined in the hollow conic barrel 75. Because the interior diameter of the hollow conic barrel 75 is less than the exterior diameter of the slotted conic 74, downward pressure on the hollow conic barrel 75 causes the slotted conic 74 to compress radially inwardly causing increased frictional engagement with the cable 61 carried in the slot 74*c*. The enhanced frictional engagement of the slotted conic 74 with the cable 61 provides positional securement of the two-piece adjustable compression fixture 73 on the cable 61. As the rigid horizontal support member 23 presses downwardly on the top end portion 75*a* of the hollow conic barrel 75, the engagement of the two-piece adjustable compression fixture 73 increases.

If the flexible member for depending support 22 is a chain 91 (FIGS. 1 and 9-12) the rigid horizontal support member 23 is positioned so that it extends generally horizontally perpendicularly from the shipping container vertical wall 131 and a chain link 92 is positioned between the first end 94*a* and second end 94*b* of the clevis 94 at the second end portion 41 of the rigid horizontal support member 23. A clevis pin 97 is extended through the first end 94*a* of the clevis 94, through the space 93 defined by the chain link 92 and threadably engaged with the second end 94*b* of the clevis 94. The process is repeated to interconnect the first end portion 40 of the rigid horizontal support member 23 to the chain-type flexible member for depending support 22.

If the flexible member for depending support 22 is a rope 101 (FIGS. 18-22) the rope 101 is threaded through the releasable anchor 21 preferably with more than one "wrap" 21 to prevent inadvertent sliding of the rope 101 relative to the releasable fastener 21. One terminal end portion of the rope 101 is threaded downwardly through the first through hole 104 defined in end portion of the rigid horizontal support member 23 which is closest to the proximate end portion 40, 41. The same end portion of the rope 101 is thereafter threaded upwardly through the second through hole 105 from the bottom 43 through the top 42 and thereafter the same end of the rope 101 is threaded downwardly through the third through hole 106 from the top 42 and exiting out the bottom 43.

A length of the rope 101 is passed through the holes 104, 105, 106 so that a desirable length of rope 101 depends from the third through hole 106 so that another vertically spaced apart rigid horizontal support member 23 may be interconnected with the rope 101 spacedly below the first rigid horizontal support member 23. The process of threading the rope 101 through the first, second, and third through holes 104, 105, 106 respectively is repeated at the opposing end portion of the rigid horizontal support member 23.

If the flexible member for depending support 22 is a strap 111 (FIGS. 13-17) stitching 112 is preferably used to fixedly interconnect in the strap 111 with the releasable anchor 121 to prevent undesirable sliding of the strap 111 relative to the releasable anchor 21. First end portion 121 of the strap 111 is threaded into the cam buckle 117 by passing the first end portion 121 between the side portions 117*a* and 117*b* and between the cam 119 and the cam end portion 120*b* of the spring biased lever 120. A user may need to exert manual pressure on the handle 120*a* to pivot the cam end portion 120*b* away from the cam 119 so that the strap 111 may be threaded therethrough. Once the strap 111 is threaded through the cam buckle 117, the strap 111 may be freely drawn downwardly through the cam buckle 117 to provide the necessary adjustments. The process is repeated to thread the remaining leg 121, 122 of the strap-type flexible member for depending support 22 through the cam buckle 117 at the second end portion 41 of the rigid horizontal support member 23.

If squaring foot 46 is to be used, and the squaring foot 46 is not structurally interconnected with the rigid horizontal support member 23, the squaring foot 46 is interconnected with the second end portion 41 of the rigid horizontal support member 23 so that the squaring foot 46 is in direct frictional contact with the Sea-Land shipping container vertical wall 131 as the hanger 20 depends from the lashing ring 134. The squaring foot 46 may interconnect with the second end portion 41 of the rigid horizontal support member 23 by a variety of means including but not limited to a protuberance (not shown) that releasable engages with a channel (not shown) defined by the rigid horizontal support member 23, the squaring foot 46 may carry a "hoop" (not shown) defining an internal periphery that fits over and about the outer periphery of the second end portion 41 of the rigid horizontal support member 23, or the squaring foot 46 may define a cavity (not shown) having an internal periphery that accommodates the second end portion 41 of the rigid horizontal support member 23 therein.

The process for installing the second hanger 20 spaced apart from the first hanger 20 is similar to as previously noted.

After the second hanger 20 has been installed, shelf planks 136 may be installed on the hangers 20 by passing the shelf planks 136 between the first leg 31 and the second leg 32 the flexible members for depending support 22 and resting the shelf planks 136 directly upon the top portion 42 of the rigid horizontal support members 23. Depending upon the width of the shelf planks 136, forward shelf edge may be in direct frictional contact with the first leg 31*a* of the flexible member for depending support 22 at the first end portion 40 of the rigid horizontal support member 23 and rearward shelf edge may be in direct frictional contact with the shelf barb 49. By forcing the shelf planks 136 rearwardly, the shelf barb 49 may be driven into the edge portion of the shelf plank 136 securing the shelf plank 136 relative to the rigid horizontal support member 23 and the hanger 20.

Having thusly described my invention, what I desire to protect by Letters Patent, and

What I claim is:

1. A flexible adjustable storage system for Sea-Land shipping containers carried by spaced apart lashing rings to depend therefrom on atop a wall inside the Sea-Land shipping container, the flexible adjustable storage system comprising in combination: a Sea-Land shipping container having at least one vertical wall and a floor and spaced apart lashing rings carried by the at least one vertical wall spacedly above the floor; at least two spaced apart hangers, each hanger having an elongate flexible member for vertical support, having a first leg with a first end portion and a second leg with a second end portion, a releasable anchor communicating with the flexible member for vertical support to releasably interconnect with the spaced apart lashing rings so that the first leg and the second leg depend therefrom adjacent the wall, at least one rigid horizontal support member extending between the first leg and the second leg for carriage of a load thereon, each rigid horizontal support member having a first end portion and an opposing second end portion; a fastener for adjustably interconnecting the rigid horizontal support member to the first leg and the second leg of the flexible member for vertical support; a shelf barb bracket extending perpendicularly upwardly is mounted thereon top surface of the at least one rigid horizontal support member, near the elongate flexible member first leg; and a shelf barb carried by the shelf barb bracket extending perpendicularly to the shelf barb bracket and parallel to the rigid horizontal support member with a pointed end portion oriented away from proximate end portion of the rigid horizontal support member.

2. A flexible adjustable storage system for Sea-Land shipping containers carried by spaced apart lashing rings to depend therefrom on atop a wall inside the Sea-Land shipping container, the flexible adjustable storage system comprising in combination: a Sea-Land shipping container having at least one vertical wall and a floor and spaced apart lashing rings carried by the at least one vertical wall spacedly above the floor; at least two spaced apart hangers, each hanger having; an elongate flexible member for vertical support, having a first leg with a first end portion and a second leg with a second end portion, a releasable anchor communicating with the flexible member for vertical support to releasably interconnect with the spaced apart lashing rings so that the first leg and the second leg depend therefrom adjacent the wall, at least one rigid horizontal support member extending between the first leg and the second leg for carriage of a load thereon, each rigid horizontal support member having a first end portion and an opposing second end portion, each end portion, having a fastener for adjustably interconnecting the rigid horizontal support member to the first leg and the second leg of the flexible member for vertical support; at least one shelf plank carried on and extending between the at least one rigid horizontal support member of each hanger for carriage of a load thereon; a shelf barb bracket extending perpendicularly upwardly is mounted thereon top surface of the at least one rigid horizontal support member, near the elongate flexible member first leg; and a shelf barb carried by the shelf barb bracket extending perpendicularly to the shelf barb bracket and parallel to the rigid horizontal support member with a pointed end portion oriented away from proximate end portion of the rigid horizontal support member.

3. An adjustable storage system for Sea-Land shipping containers carried by spaced apart lashing rings to depend therefrom on atop a wall inside the Sea-Land shipping container, the adjustable storage system comprising in combination: a Sea-Land shipping container having at least one vertical wall and a floor and spaced apart lashing rings carried by the at least one vertical wall spacedly above the floor; at least two spaced apart hangers, each hanger having; an elongate member for vertical support, having a first leg with a first end portion and a second leg with a second end portion, a releasable anchor communicating with the elongated member for vertical support to releasably interconnect with a lashing ring inside the Sea-Land shipping container so that the first leg and the second leg depend therefrom adjacent the wall, at least one rigid horizontal support member extending between the first leg and the second leg for carriage of a load thereon, each rigid horizontal support member having a first end portion and an opposing second end portion; a fastener for adjustably interconnecting the rigid horizontal support member to the first leg and the second leg of the elongated member for vertical support; a shelf barb bracket extending perpendicularly upwardly is mounted thereon top surface of the at least one rigid horizontal support member, near the elongate member first leg; and a shelf barb carried by the shelf barb bracket extending perpendicularly to the shelf barb bracket and parallel to the rigid horizontal support member with a pointed end portion oriented away from proximate end portion of the rigid horizontal support member.

* * * * *